US007670080B2

(12) United States Patent
Tzaig

(10) Patent No.: US 7,670,080 B2
(45) Date of Patent: Mar. 2, 2010

(54) CATCH BASIN SYSTEM

(76) Inventor: Moshe Tzaig, 1555 Ronne Dr., Santa Rosa, CA (US) 95404

( * ) Notice: Subject to any disclaimer, the term of this patent is extended or adjusted under 35 U.S.C. 154(b) by 401 days.

(21) Appl. No.: 11/686,521

(22) Filed: Mar. 15, 2007

(65) Prior Publication Data

US 2007/0215783 A1 Sep. 20, 2007

Related U.S. Application Data

(60) Provisional application No. 60/782,490, filed on Mar. 15, 2006.

(51) Int. Cl.
*E01C 11/22* (2006.01)

(52) U.S. Cl. ..... 404/5; 404/4; 249/8; 249/188; 210/170.03

(58) Field of Classification Search ..... 249/8, 249/188, 187.1; 404/2, 3, 4, 5; 210/170.03
See application file for complete search history.

(56) References Cited

U.S. PATENT DOCUMENTS 881,003 A * 3/1908 Kennelly ..... 404/4
4,192,625 A * 3/1980 Peletz ..... 404/5
4,637,585 A * 1/1987 Picollo ..... 249/10
6,234,711 B1 * 5/2001 Beaman ..... 404/4
7,040,838 B2 * 5/2006 Allard et al. ..... 405/36
2002/0164209 A1 * 11/2002 Allard et al. ..... 405/36
2008/0245710 A1 * 10/2008 Mitchell et al. ..... 210/85

* cited by examiner

*Primary Examiner*—Gary S Hartmann
(74) *Attorney, Agent, or Firm*—Edward S. Sherman

(57) ABSTRACT

A drainage catch basin is formed from a rectangular trough with a planar upper rim defined by at least two opposite sidewalls and includes at least one inner wall forming a lower rim to define the gutter opening for flush mounting with the curb. The basin is covered by a top with a planar bottom that preferably includes a central circular manhole cover. The top is preferably formed by first providing a mold having a bottom and side frame of steel plates reinforced by a galvanized steel nosing and crossing rebar. The mold is then filled by concrete casting while installed on the catch basin trough to match the exterior color and/or finish of the adjacent sidewalk, street and/or curb.

20 Claims, 11 Drawing Sheets

100
120
110
111
707
711
708
701

700
707'
700'
713
729
720'
715
90°
90°
711
705
704
84°
703
701
702

700

750
711
701
702
703
700'
708
C
708
707
707'
715

705
C
705
705

CATCH BASIN SYSTEM

CROSS REFERENCE TO RELATED APPLICATIONS

The present application claims priority to the U.S. provisional application for a "Catch Basin System", having Ser. No. 60/782,490 and filed on Mar. 15, 2006, which is incorporated herein by reference.

BACKGROUND OF INVENTION

The present invention relates to catch basins used to collect storm waters at the curb of a street or parking lot.

Storm drains and catch basins generally deploy square box with a table like top or cover having two or three closed sides and at least one open side that forms a drain hole for water to flow from the street and gutter into the square box. The square box serves as a junction for large buried drain pipes that carry the street run off to a safe location for disposal.

Such types of catch basins and systems are difficult to install precisely, as the bottom of the drain hole should be level with the street level, while the protective cover should be level with the sidewall. Thus, installation can require considerable labor and rework to properly install the box for adequate drainage performance as well as the top to avoid a discontinuity in the adjacent sidewalk or curb.

As most of the catch basin systems are pre-cast concrete, a method has been developed to use a fiberglass mold to cast the table like portion from concrete in the field. This permits the matching of exposed portion of the catch basin color and/or finish to match the adjacent sidewalk. However, such fiberglass molds are easily damaged or distorted. In addition, they require considerable labor to build wooden frames or dams to define the outside walls of the table like top portion. In additional, while it is possible to add to the mold an angle iron shaped strip to form a protective edging for the cast concrete, such strips are not stable in the mold and frequently delaminate, either due to distortion or floating of the mold in the wet concrete mix.

It is therefore a first object of the present invention to provide a catch basin system that is easier to install precisely, with minimum labor.

It is another objective to provide a catch basin system where it is simpler and requires less labor to match the color and/or surface finish of the adjacent sidewalk.

It is still another objective of the invention to provide a catch basin cover or lid is stronger and more durable.

Yet another objective of the invention to provide a catch basin system more compatible with the attachment of draining pipes from just below the ground A further objective of the invention is to provide a cover or lid is easy to remove and replace if damaged.

A still further objective is to provide a method and article for casting lids in larger sizes than possible with existing fiberglass frames.

Another objective is to provide a method of casting strong, durable and robust gallery drain section for deployment along the curb adjacent to catch basins.

SUMMARY OF INVENTION

In the present invention, the first object is achieved by providing a catch basin with at least one side lower than the two adjacent side to form a drainage opening and the higher sides forming a rim for receiving and supporting a substantially planar top cover.

A second object of the invention is achieved by providing a metal or steel frame mold for receiving cast concrete to form the top cover and/or gallery sections for various types of catch basins, allowing the matching the color and/or finish of the top to basin to the adjacent sidewalk. The mold includes an integrated metal nosing to protect the solid concrete from damage from vehicles.

Another object of the invention is achieved by providing appendages and/or handles at corners of the top or the mold for the top for lifting and placement on the rim the catch basin base.

Another object of the invention is achieved by providing a catch basin formed of an upper and lower portion having matching steps at the common edge for a process of installation wherein the lower section is first installed so that drain pipes can be attached, the upper section being installed after the nearby trenching for pipes is back filled and intended street and sidewalk are graded.

Another object of the invention is achieved by providing in the top lid or the mold for forming the top lid, an inner lid frame and circular extending flange for receiving and supporting a round or circular manhole cover.

The above and other objects, effects, features, and advantages of the present invention will become more apparent from the following description of the embodiments thereof taken in conjunction with the accompanying drawings.

DETAILED DESCRIPTION

Figure 1:
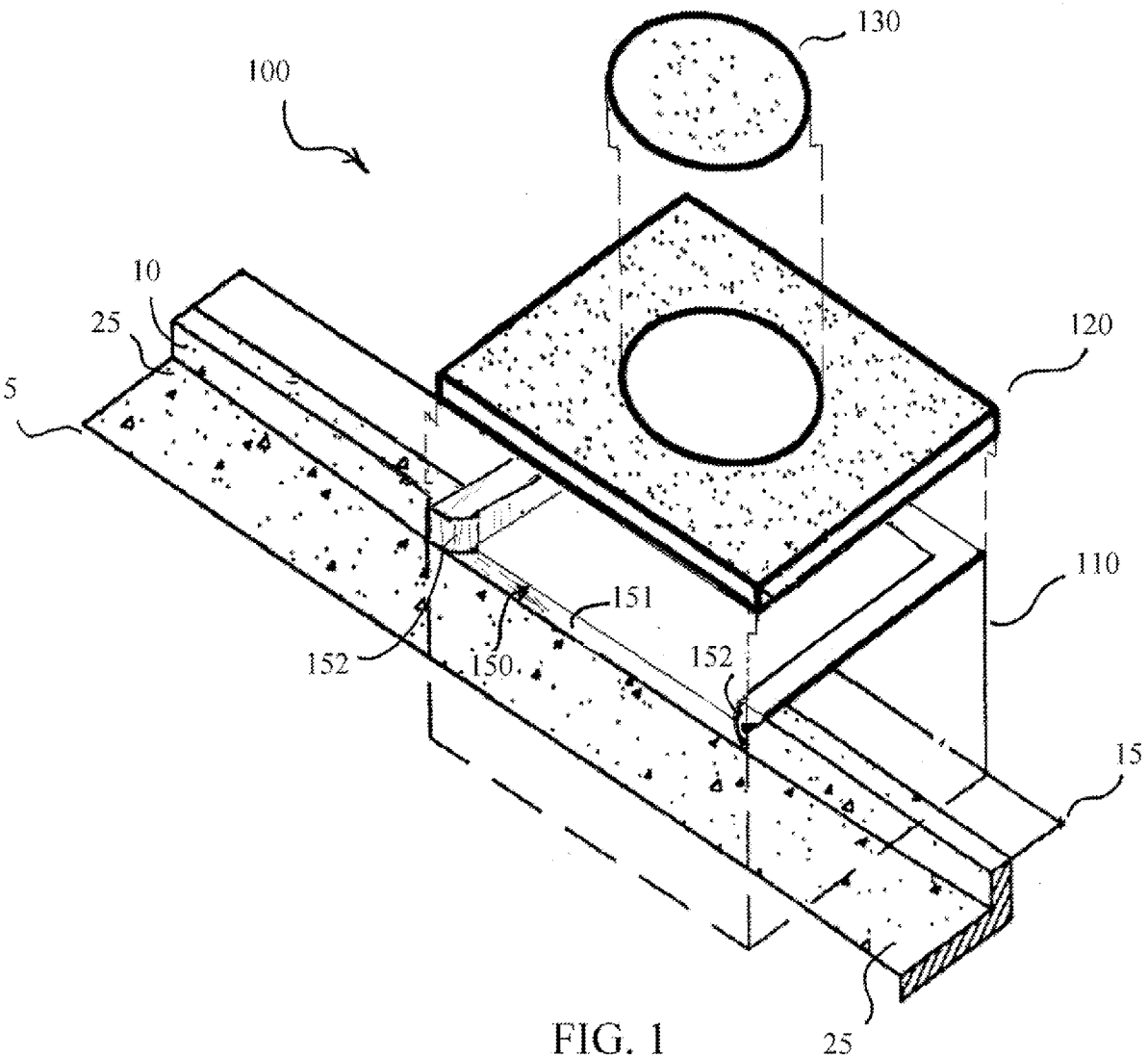
FIG. 1 is an exploded view of a catch basin system according to a first embodiment of the invention.

Referring to FIGS. 1 through 8, wherein like reference numerals refer to like components in the various views, there is illustrated therein a new and improved Catch Basin System, generally denominated 100 herein.

In accordance with the present invention, one embodiment of the catch basin system 100 comprises a base 110 and a top 120. The top 120 is supported by at least the upright sidewalls of base 110 such that the upper surface of top 120 is preferably flush with the ground level 15. The front face of an upper wall of base 110 is lower than at least the two adjacent walls to forms a drain hole 150 that receives water flowing from the street level 5 to the gutter surface 25. The height of the opening of the drain hole 150 is intended to be substantially the same as the height of curb face 110.

The base 110 has a plurality of underground portholes 115 for connecting to underground drain pipes 30. As base 110 also has a bottom, water entering base 110 via opening or drain hole 150 is drained out via pipes 30. Preferably, the base 110 and top 120 are formed of structurally reinforced concrete.

The exposed surfaces through the upper walls of the base 110 that are bisected by the drain hole opening 150 are preferably curved to promote weir type flow of water into the base 110. Accordingly, the horizontal surface 151 at the bottom of the drain hole 150, and the two adjacent vertical surfaces 152, are continuously curving inward from the gutter side of drain hole 150 such that a tangent to this curve (as shown by reference line 153) is substantially perpendicular to the outer surface of the upper wall. Thus, water flowing over the gutter surface 25 enters basin 110 by spilling over weir like horizontal surface 151. In contrast, water flowing down the curb edge surface 10 is efficiently directed into basin 110 by weir like vertical surface 152. In addition, a trash guard rail 111 preferably runs the length of the drain hole opening 150 just above the horizontal weir 151, tying into the two opposing vertical weir sections 152. The trash guard rail 111 typically has a diameter of about ¾ inch (16 mm).

The top 120 has a circular hole for receiving a circular manhole lid 130. The top also has a front nose section 129 that can be formed from a steel or galvanized iron bar of L-shaped cross section at the front edge. Front nose section 129 typically has a thickness of about ¼ inch (6 mm). This reinforced top nose section is meant to protect the concrete, which generally forms the remainder of top 120 (as will be described with respect to other embodiments) from damage when hit by car tires as well as to at least partially support the weight of a car. The top generally has a thickness of about 4 inches (100 mm). In other embodiments, the front nose section or its equivalent is formed as an integral part of the mold used to form top 120. The edge of the nose is preferably tilted backward such that angle $\alpha$ is somewhat less than 90 degrees with respect to the horizontal.

Preferably, the sides 120*b* of the top 120 have threaded inserts 121 for in a first instance, receiving eye-hooks 122. The eye-hooks 122 provide a convenient means to attach chains from an overhead crane or lift so that the lid can be aligned and leveled as it is lowered and installed on the base 110 in the field. Once the top lid 120 is set on base 110 the four eye-hooks 122 are then removed from the threaded inserts and replaced with four steel reinforcing bars 124 (rebar) that are each preferably threaded on at least one end. Thus, when the sidewalk is formed by pouring concrete up to the sides of top 120, the rebar 124 will tie in, that is structurally connect and reinforce, the top lid 120 and the adjacent sidewalk.

Figure 2:
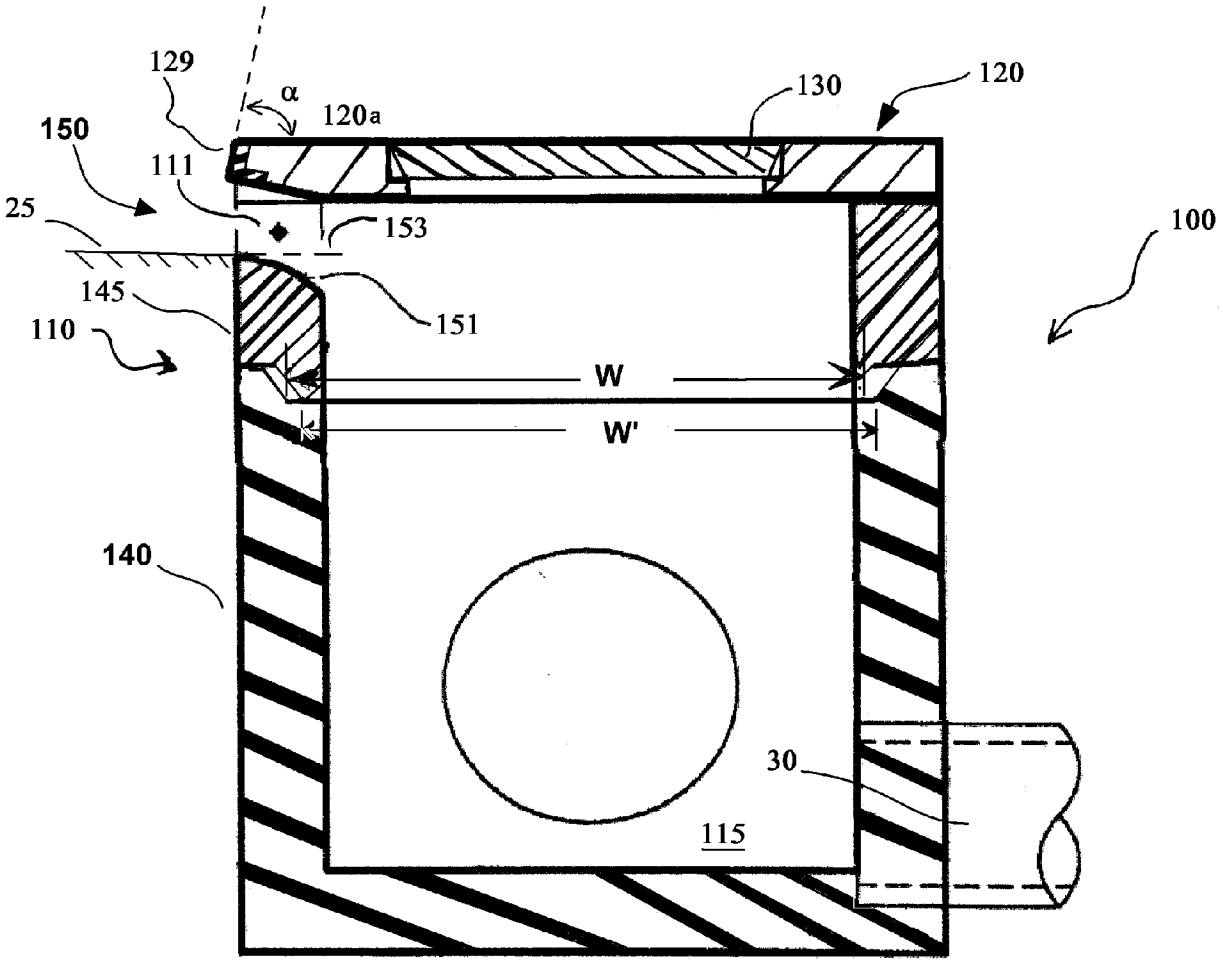
FIG. 2 is a side cross-sectional elevation of an installed catch basin system according to another embodiment of the invention
Figure 3:
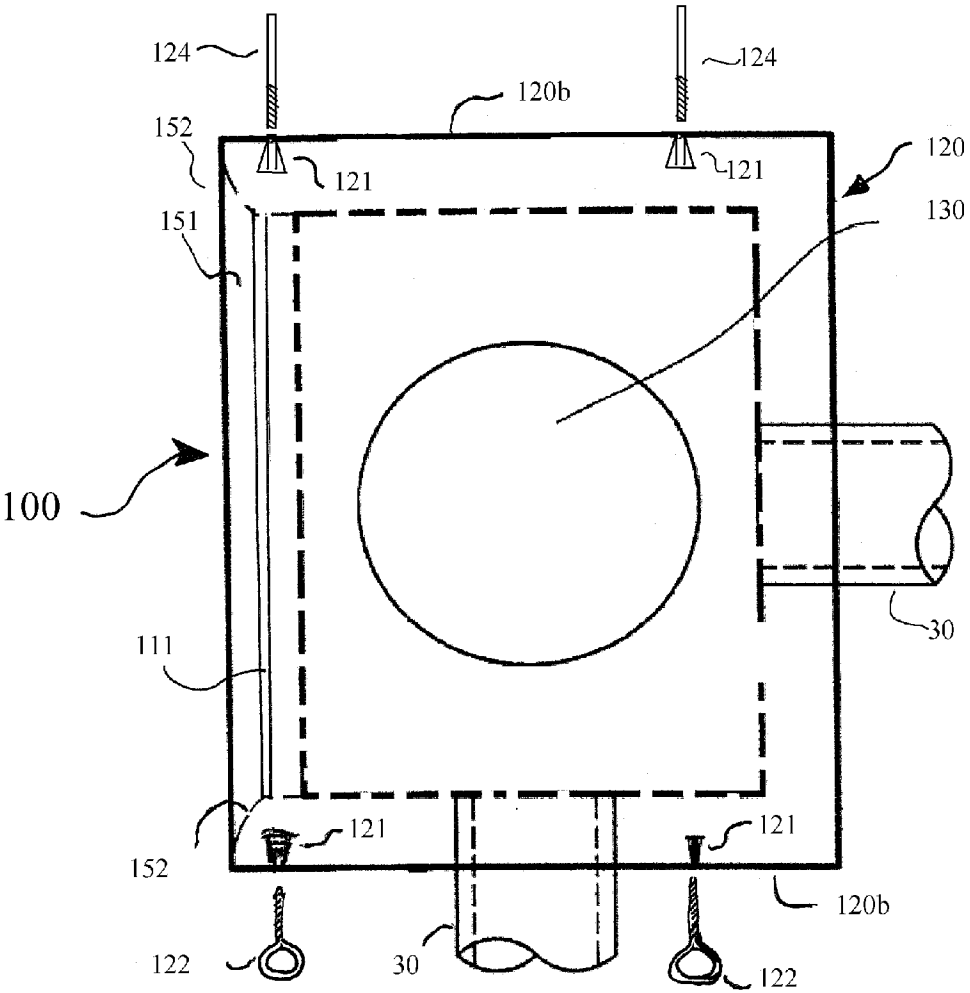
FIG. 3 is a plan view of one embodiment of a curb inlet top as installed on the catch basin of FIG. 1 or 2.

In another embodiment of the invention, shown in FIG. 2, the base 110 is comprised of two intermeshing portion, a gutter base 140 that forms the lower half of the completed base 110 and the gutter section 145, which forms an upper section of the completed base 110. While the total depth of the base 110 is typically 4 to 6 feet (1.5 to 2 meters), the gutter section 145 preferably has a height of about 12 inches (300 mm). Preferably, the bottom edge 145*b* of the gutter section and the top edge 140*a* of the gutter base 140 each have a horizontal jog slightly off center to aid in the placement and positioning of one on the other. The total width, w, between the jog in the gutter section 145 is less than the total width, w', between the jog in the gutter base 140 such that the gutter section 145 will sit within the gutter base 140, yet can be vertically adjustable over the range of (w'-w)/2. This permits a catch basin assembly process wherein the gutter basin 140 is first placed in a trench for the attachment of drain pipes 30. In the subsequent steps, the adjacent trenches are optionally filled so that the final grading for the street and sidewalk can be completed. The opening in the top of the gutter base 140 is optionally protected by a wooden panel or cover spanning width w' such that dirt or back fill material does not readily enter the completed catch basin 100. Thereafter, the gutter section 145 is aligned with the lateral extent of the street and gutter. Subsequently, any further gap between the curb face edge 10 and the sidewalk position can be accommodated by adjusting the later placement of the top 120.

Figure 4:
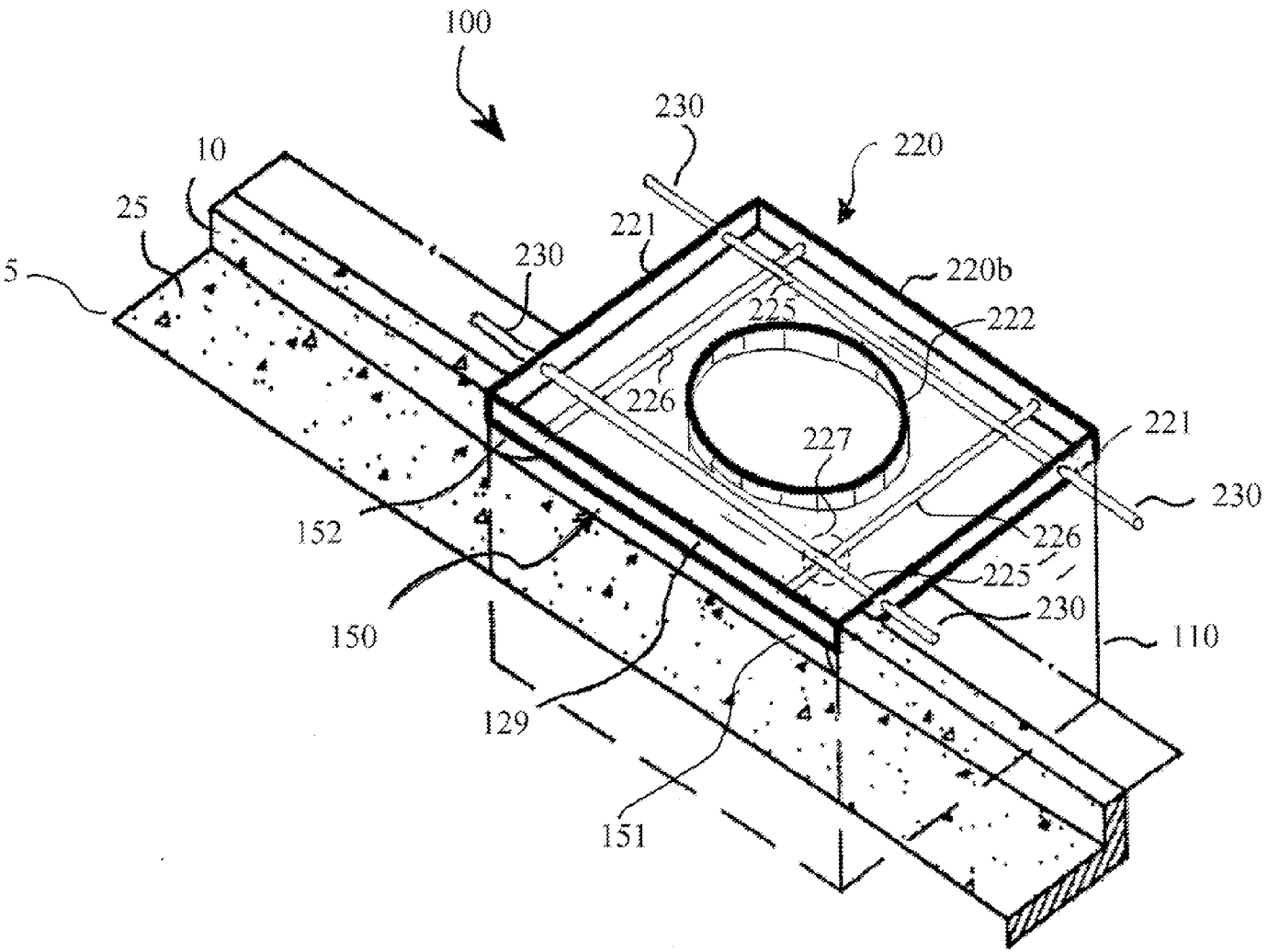
FIG. 4 is a perspective view of another embodiment of a catch basin system wherein the curb inlet top is to be cast in place on the catch basin of FIG. 1 or 2.
Figure 5A:
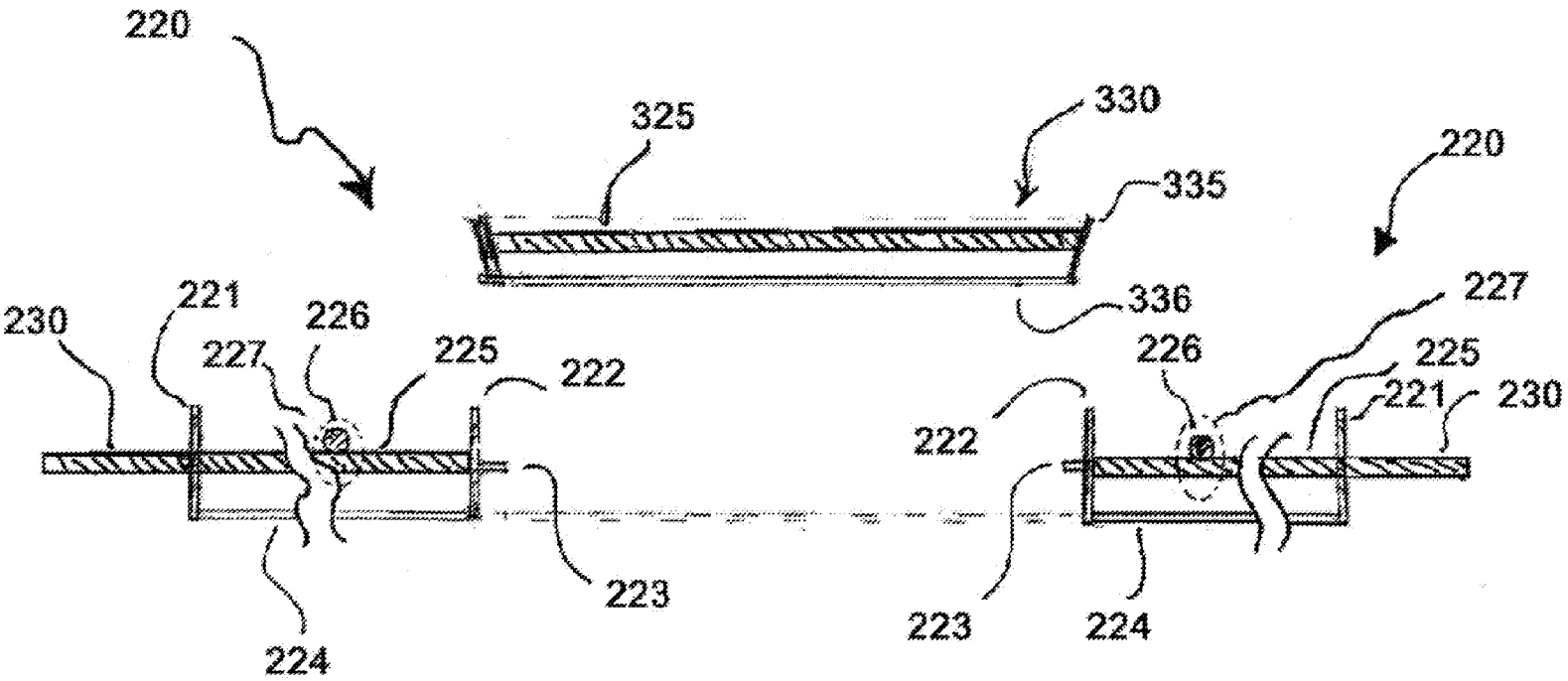
FIG. 5A is a front cross-sectional elevation of the mold shown in FIG. 4.

In another embodiment of the invention, shown in FIGS. 4 and 5AB, the top 120 is formed by first installing the base 110 and then setting a top mold 220 on the base. The top mold 220 is then filled with concrete.

The top mold 220 includes reinforcing curb angle 129 that defines a nose section meant to protect the concrete from damage when hit by car tires, or preferably at least partially support the weight of a car. Thus, the reinforcing curb angle 129 is disposed at the front of the top, which is the side intended to face the street 5. The top mold has a bottom section 224 and attached back edge 220*b*. Also attached to the periphery of mold bottom 224 is side edges 221. Thus, bottom 224 being surrounded at the periphery by upright sides formed of reinforced curb angle 129, side edge 224 and back edge 220*b* is a fluid containing vessel for receiving poured concrete intended to be solidified therein.

At least two longitudinal rebars 225 span between, yet extend beyond upright side walls 221, the extending portion forming four external re-bar handles 230. At least two transverse rebars 226 span between the reinforcing curb angle 129 and the back edge 220*b*. The longitudinal and transverse rebars 225 and 226 are preferably welded to the upright sides of the mold 220 walls, as well as to each other where they cross adjacent to each other a reference numeral 227. Within the center of mold 220 is a circular penetration having a surrounding up right wall or outer ring 222 for receiving a circular manhole 130. A circular laterally extending outer ring band 223 is disposed on the interior of the outer ring 222 for catching the bottom edge of circular manhole lid 130.

The top mold 220 also includes provisions for forming a circular manhole lid 130 using lid mold 330. As shown in more detail in FIG. 5B, the lid mold 330 has a circular upright wall or lid ring 335 surround the periphery of the horizontal lid pan 336 to define a fluid containing vessel for receiving concrete to be solidified therein. Preferably, at least one section of rebar 325 spans the diameter of the mold 330, being welded at opposing ends to lid ring 335. More preferably, the lid ring 335 surrounding lid pan 336 is canted outward as it extends upward to facilitate the removal of the completed lid 130 from the completed top 120 after fabrication as well as after field deployment. Thus, lid mold 330 can be filled with concrete and finished either separately from top mold 220, or while resting on outer ring band 223. In the later case both the top mold 220 and the lid mold 330 are simultaneously filled with concrete and finished. It should be appreciated that the mold portion 220 and 330 are left in place after this casting process to reinforce the cast concrete.

In a preferred embodiment for the top mold 220, a trash guard rod 111 is attached to the bottom surface of the mold of the front edge 129, descending downward there from, rather than being formed or cast into the base 110.

The mold 220 is preferably formed by welding steel plates and is subsequently galvanized to provide corrosion resistance. For a 4 foot by 4 foot (1.2 by 1.2 meters) mold with a 4 inch (100 mm) height as defined by the side walls, 10 gauge (3.5 mm thick) steel plates generally provide sufficient strength to support the weight of the wet concrete mixture. As the galvanizing process is carried out at high temperatures that might otherwise distort the welded sheets, it should be appreciated that the reinforcing curb angle 129, being made of thicker steel, as well as the attached rebar 225 and 226 help to stabilize the mold during the galvanization process, as well as any subsequent handling and placement. Thus, the resulting mold 220 has a relatively light weight such that is can be handled and readily aligned on top of a base 110 by two people without a crane or overhead lift. Further, due to the reinforcement provided by the reinforcing curb angle 129 and rebar, the mold is sufficiently stable dimensional that it can be made into larger stable sizes than commercially available fiber glass molds used to build the table like portion of prior art catch basins. In contrast to the fiberglass molds used to form a table like catch basin top, mold 220 does not require the construction and assembly of plywood dams to form the table "legs" or upright sides, thus facilitating field installation with minimum labor.

Figure 5B:
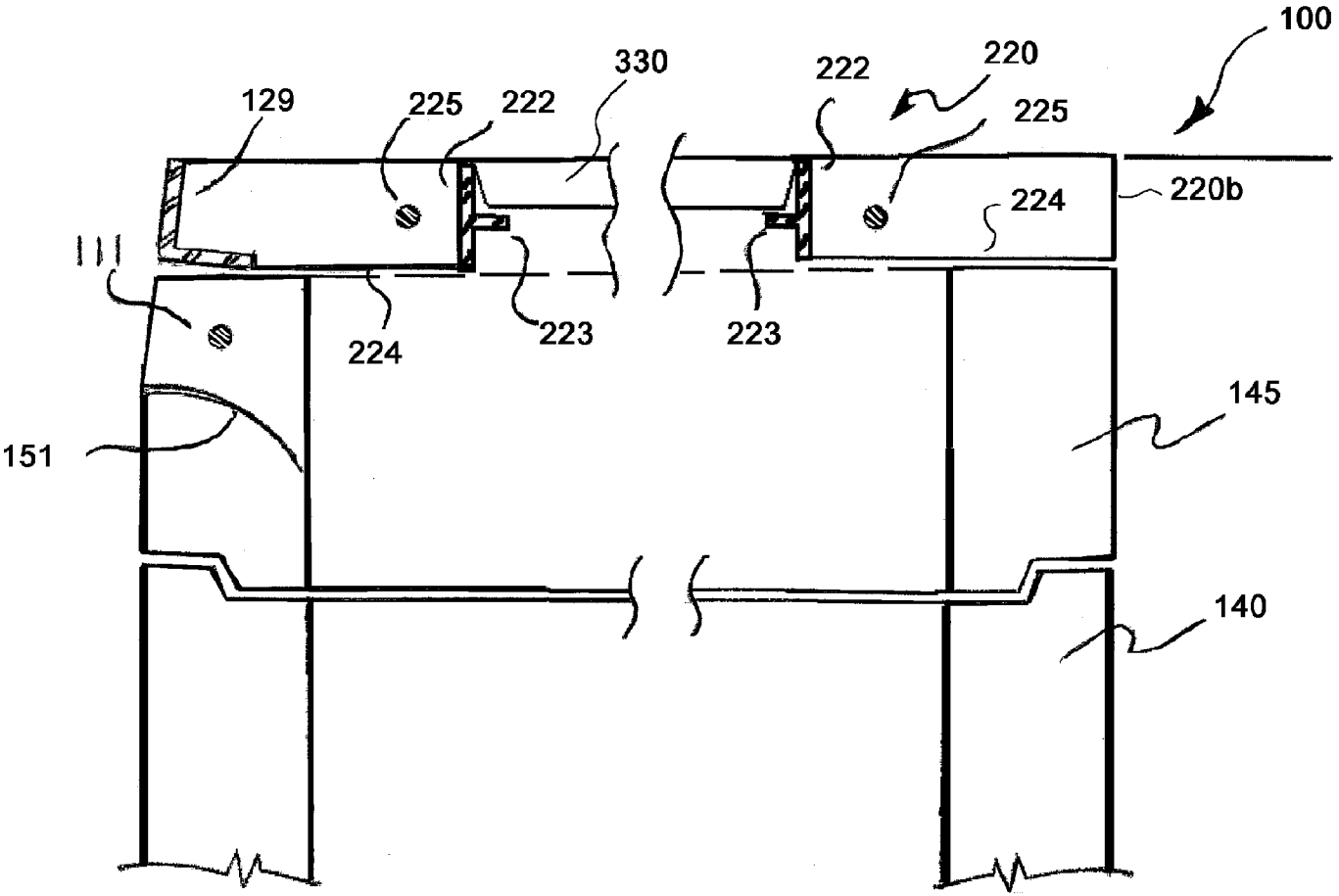
FIG. 5B is a side cross-sectional elevation of the mold shown in FIG. 5B
Figure 5C:
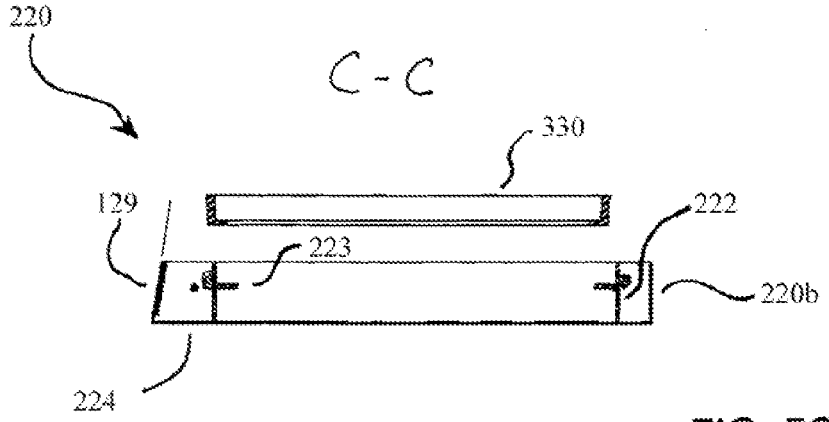
FIG. 5C is a side cross-sectional elevation of an alternative embodiment to the mold shown in FIG. 4
Figure 5D:
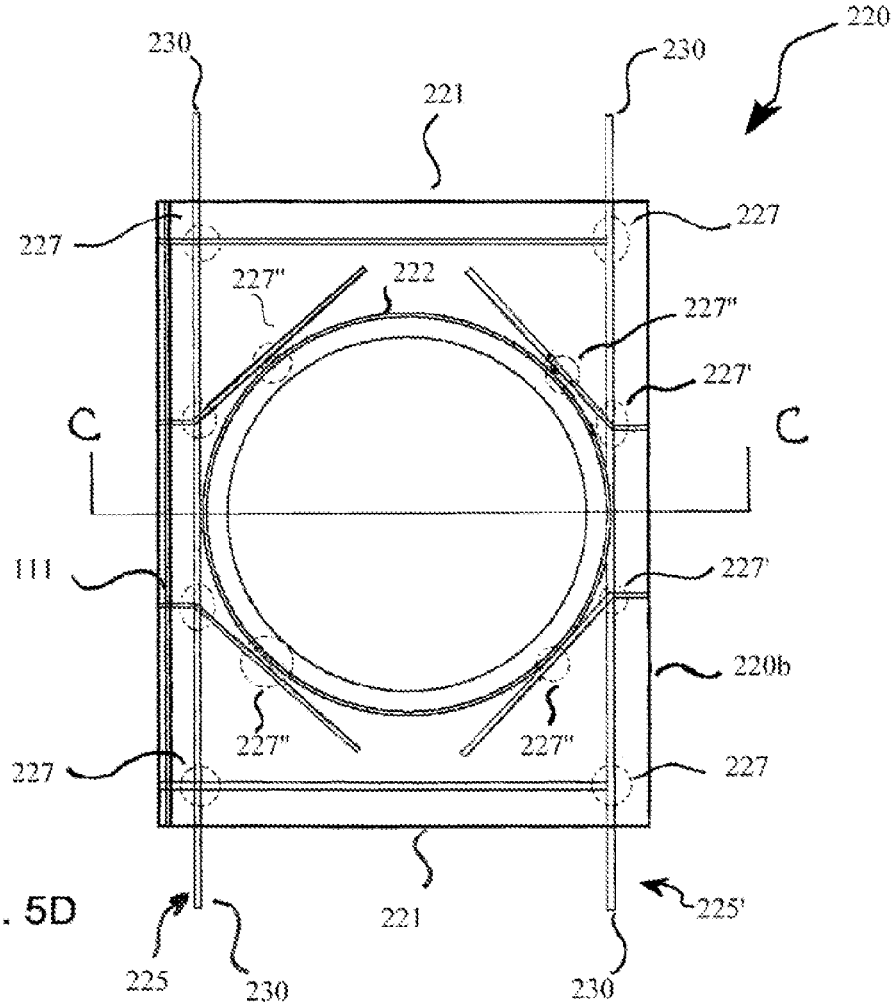
FIG. 5D is a plan view of the alternative embodiment of a mold shown in FIG. 5C.

An alternative embodiment of the top mold 220 shown in FIGS. 4, 5A and 5B is now illustrated in FIGS. 5C and 5D. The mold shown in the plan view in FIG. 5D is now has a rectangular shape. At least two longitudinal rebars 225 span between and then beyond upright sidewalls 221, with extending portions forming four external re-bar handles 230. At least two transverse rebars 226 span between the reinforcing curb angle 129 and at least the rearward of the two longitudinal rebars section 225'. The longitudinal and transverse rebars 225, 225' and 226 are preferably welded to the upright sides of the mold 220 walls, as well as to each other where they cross adjacent to each other at the region with reference numeral 227. Four additional rebars 228 reinforce and stabilize mold 220 by extending from the opposing upright sides defined by the reinforced curb angle 129 and back edge 220*b* toward the exterior of the outer ring 222 in a first segment 228*a*, before extending at about a 45° angle in a second segment 228*b*. Segment 228*b* of rebar 228 is preferably attached to at least one of the longitudinal rebars 225 or 225' (labeled as region 227') as well as the exterior of the outer ring 222 (labeled as region 227").

Figure 6:
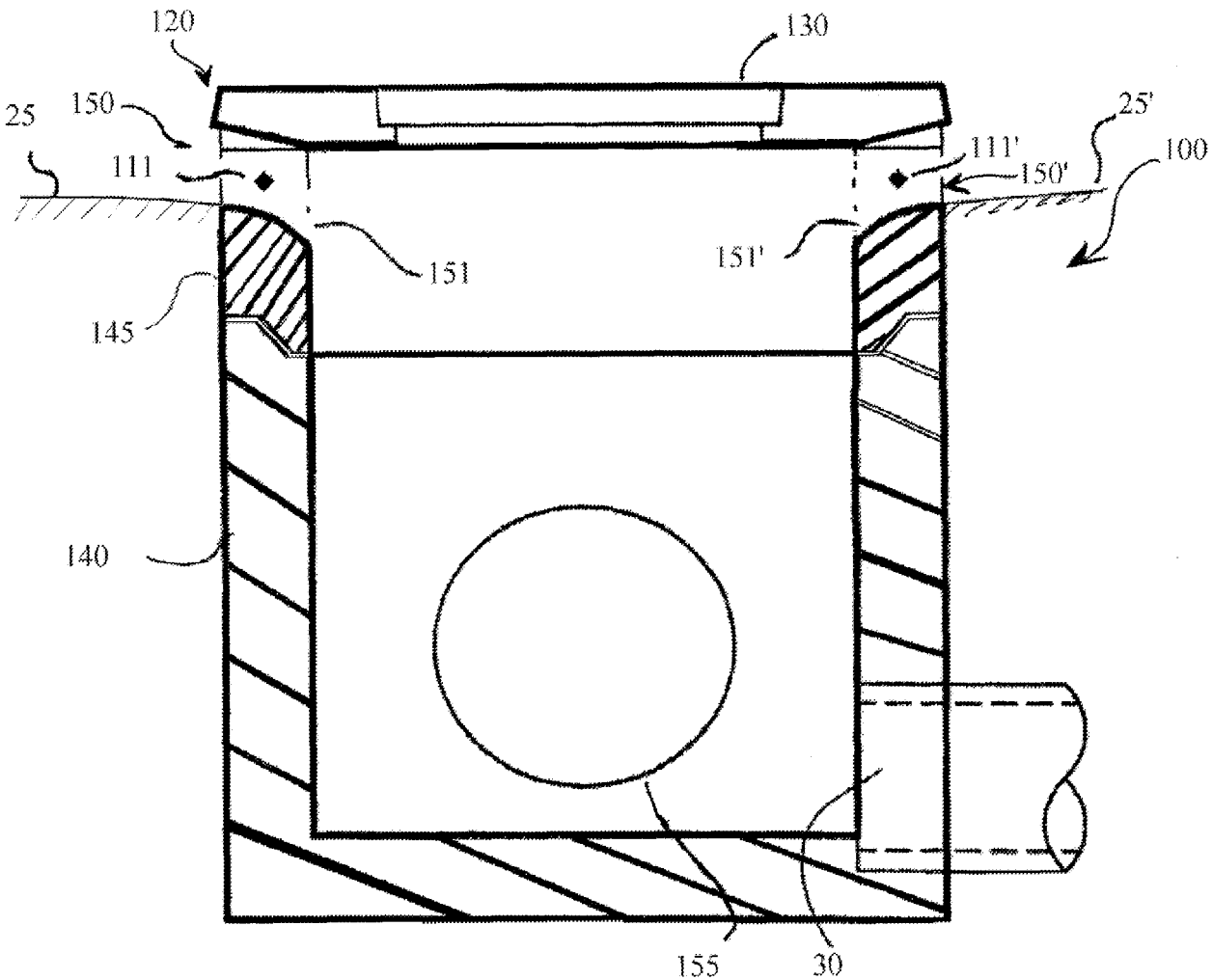
FIG. 6 is a side cross-sectional elevation of an installed catch basin system according to another embodiment of the invention.

In another embodiment shown in FIG. 6, the base has two drain holes 150 and 150' on opposite sides for use in a parking lot. The top 120 would form part of a walkway between the parking strips having gutters 25 and 25'. Likewise, trash bars 111 and 111' span each pair of the respective drain holes 150 and 150'.

Another embodiment of the invention is illustrated in FIG. 7, in which a gallery section 700 has an opening 750 that extends along the curb adjacent the catch basin to provide in combination with opening 150 in top 110 a higher receiving capacity and prevent local street flooding if, for example, the amount of precipitation exceeds the receiving capacity or part of the opening 150 is at least partial clogged by debris.

Gallery section mold 700' is preferably formed from steel or galvanized iron. As the gallery section mold 700' is left in place after pouring concrete in the shallow trough 720' to form gallery section 700, portion of the mold also become portions of the completed gallery section. The concrete top 720 of gallery section 700 rests on the top surface 709 of mold 700'. The gallery section mold also has a front nose section 729. Front nose section 729 typically has a thickness of about ¼ inch (6 mm). This reinforced top nose section is meant to protect the concrete of the gallery top 720, which generally forms the remainder of exposed portion of the gallery section 700, from damage when hit by car tires as well as to at least partially support the weight of a car. The top of the gallery section 750 generally has a thickness of about 4 inches (100 mm).

The gallery section 700 has a back wall 701, a bottom 702, a substantially vertical lower front wall 703 and weir like upper front wall 704 that curves downward with a convex upper surface from the bottom of opening 750. The downward descending lip from the edge of opening 750 at the junction with upper front wall 704. Sides 707 are substantially perpendicular to the bottom 702 to define the box like gallery section. However, the side 707' most distal from the catch basin top 110 is tilted inward from the street toward the back wall 701 of gallery section 700. Thus, water flowing down the curb edge surface 10 is efficiently directed into gallery section 700 by titled side wall 707'. In addition, a trash guard rail 711 preferably runs the length of the gallery section opening 750 just above the weir like upper front wall 704, tying into the two opposing side walls 707 and 707'. The center of trash guard rail 711 is supported one or more support plates 708. The trash guard rail 711 typically has a diameter of about ¾ inch (16 mm).

Figures 7A, 7B, 7C, 7D:
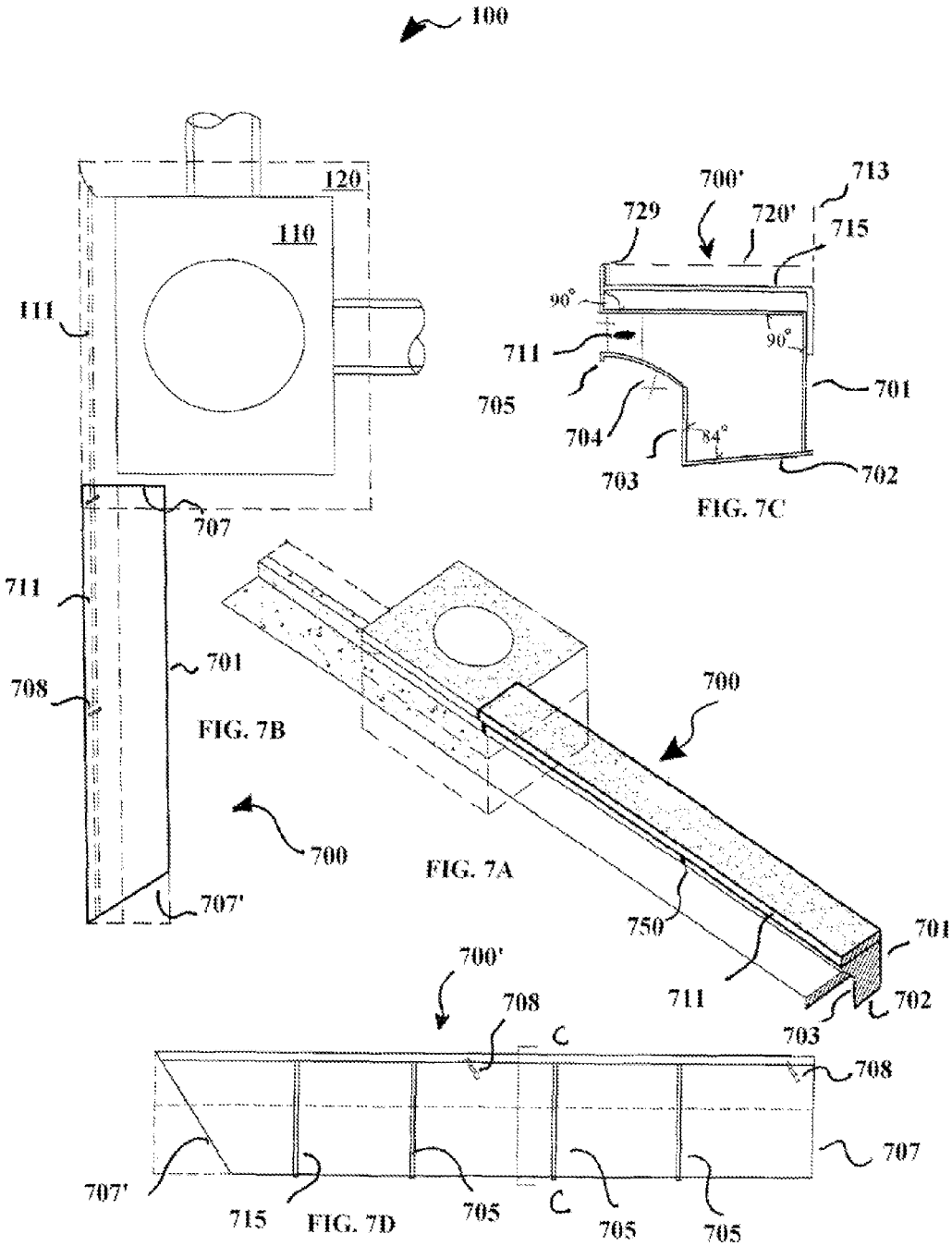
FIG. 7A is a perspective view of another embodiment of a catch basin system that includes a gallery section.
FIG. 7B is a plan view of the catch basin system in FIG. 7A.
FIG. 7C is a cross-sectional elevation through a portion of the catch basin system in FIG. 7A to show the structure of the mold used to form the gallery section.
FIG. 7D is an enlarged plan view of the gallery section mold showing the location for section C-C in FIG. 7C

In FIG. 7C, it is preferable that bottom 702 is canted upward slightly from the horizontal axis such that an acute angle of about 84 degrees is formed with respect to vertical lower front wall 703, thereby directing the collected water towards the front of the gallery section, promoting drainage and eliminating standing water.

Figure 7E:
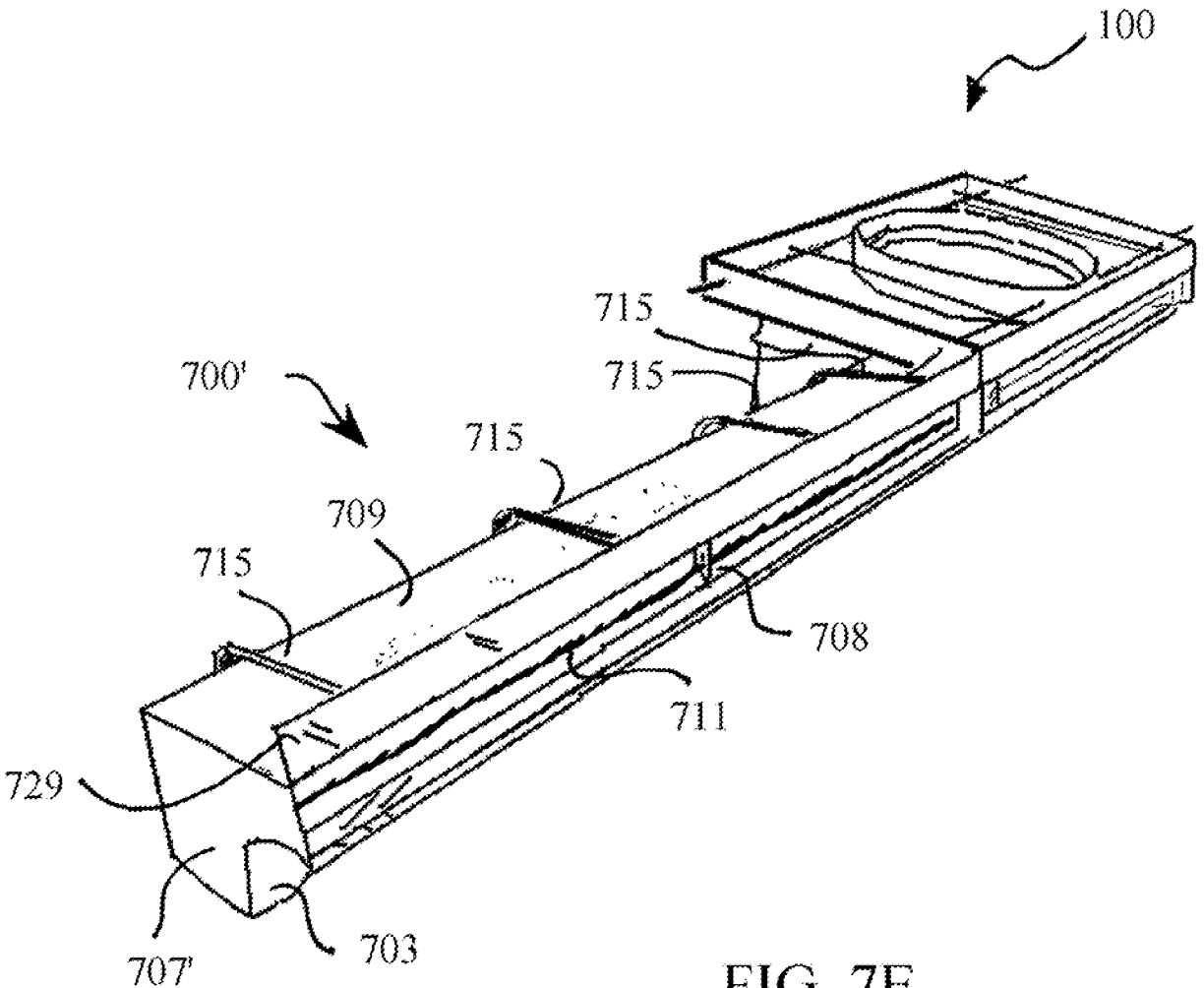
FIG. 7E is a different perspective view showing the gallery section and catch basin lid molds prior to forming the catch basin system shown in FIG. 7A.

The gallery mold 700' has a top 709 that extends laterally from the bottom of the nose guard plate 729 meeting the top of back wall 701. This gallery section mold also has a plurality of sideways L-shaped handles 715 that are spaced apart and connects the top of the nose guard 729 to the back wall 701 of the gallery section. Thus, installing the mold 700' as shown in FIG. 7E, and applying an external frame or vertical trench surface, shown as dotted line 713, in FIG. 7C, provides a convenient means to fill the cavity 720 with concrete to from the completed gallery section 700.

An additional embodiment of the invention is the catch basin system 100 shown in FIG. 8A-D that comprises a base 110 and a top 120. The top 120 of the catch basin is relatively narrow as compared with other embodiments, with the bottom 120 of the catch basin extending in front of the top 120 below the street. The top 120 is supported by at least the side upright walls of base 110 such that the upper surface of top 120 is preferably flush with the ground level 15. Preferably, the base 110 and top 120 are formed of structurally reinforced concrete.

The otherwise open section of the catch basin are not covered by top 120 and as this portion extend into the street it is covered by a frame 801 having the laterally extending grating 802. Thus, there is the potential for greater water collection capacity as water can flow into catch basin bottom 110 from the street via grating 802, rather than having to flow to opening 150.

Figure 8B:
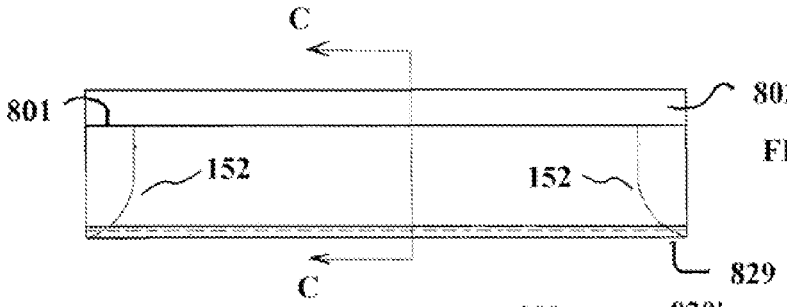
FIG. 8B is a partial plan view of the mold used to form the top of the catch basin system in FIG. 8A
Figure 8C:
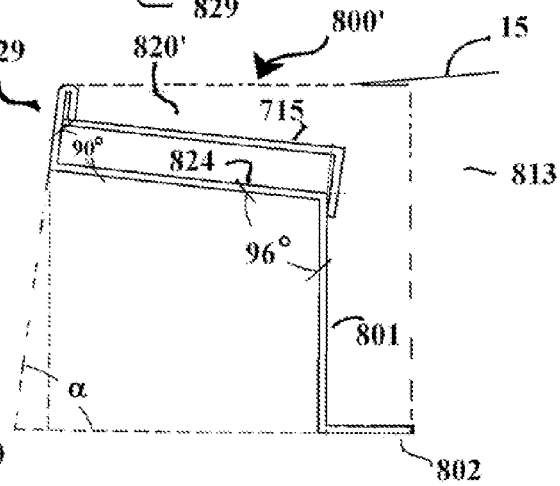
FIG. 8C is a cross-sectional elevation through a portion of the mold used to form the top of the catch basin system in FIG. 8A.
Figure 8A:
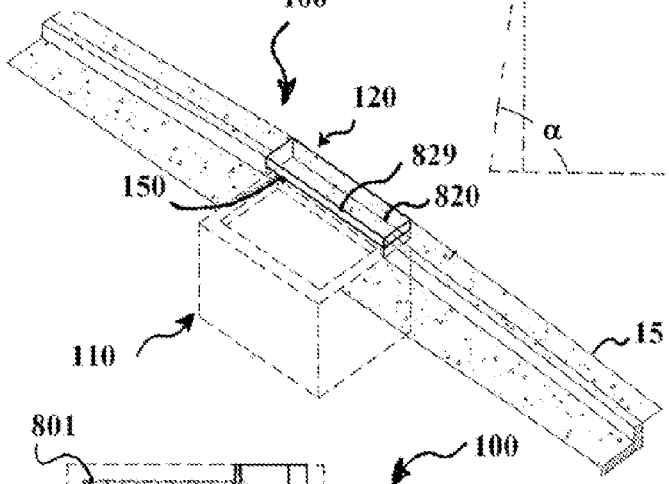
FIG. 8A is a partial perspective view of another embodiment of a catch basin system wherein the bottom is disposed under the street and primarily the portion of the catch basin that is under the curb is covered by the top that includes an integrated mold and protective nosing.
Figure 8D:
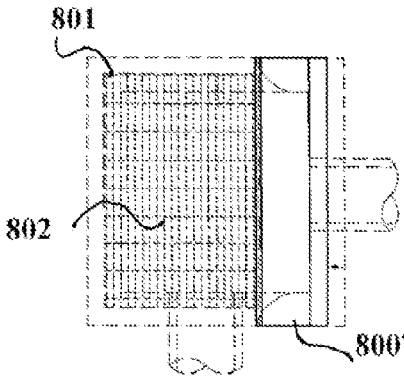
FIG. 8D is a plan view of the catch basin system of FIG. 8A showing the grate covering the portion of the catch basin that extends under the street in front of the top thereof.

Catch basin top 120 is preferably formed at least partially from steel or galvanized iron using the mold 800' shown in section in FIG. 8C. As mold 800' is left in place after pouring concrete (to the height of the horizontal dashed line) in the shallow trough 820' to form catch basin top 120, portions of the mold 800' also become portions of the completed catch basin top 120. The concrete top layer 820 of catch basin top 120 is thus disposed on the top surface 824 of mold 800'.

Top surface 824 of mold 800' extends laterally backward from opening 150 to join back wall 805. A substantially horizontal edge 802 extends outward from the bottom of back wall 805. The mold 800' also has a front nose section 829 extending upward from the front of top 824. The front nose section 829 typically has a thickness of about ¼ inch (6 mm). Preferably, the front noise section 829 has been formed by folding over the upright metal edge to double its thickness, as is shown in FIG. 8C. This reinforcing top nose section 829 is meant to protect the exposed concrete top portion 820 from damage when hit by car tires as well as to at least partially support the weight of a car. The exposed concrete top portion 820 of lid 120 generally has a thickness of about 4 inches (100 mm), which is defined by the height of top nose 829. As shown in FIG. 8C, the top surface of the mold 824 is preferably disposed at an angle greater than 90 degrees (and more preferably at about 96 degrees) with respect to back wall 805 such that the top nose section 829 is disposed at an acute angle (less than 90 degrees) $\alpha$ with respect to the horizon.

The height of the opening 150 above frame 801 and grate 892 is intended to be substantially the same as the height of curb face 110. The height of this opening is defined by the height of back wall 805 of mold 800'. The exposed lateral surfaces of top 120 adjacent opening 150 are the sidewalls 152 of the mold, which are the same height as back wall 805. These sidewall 152 are preferably curved inward to promote weir type flow of water into the base 110. Thus, water flowing down the curb edge surface 10 is efficiently directed into basin 110 by weir like sidewalls 152. Optionally, a trash guard rail 111 shown in other embodiments runs the length of the drain hole opening 150 just above the horizontal frame 801 and grating 802. Preferably, the trash guard rail has portions 111*a* that extends beyond the curved sidewalls 152, to provide handles for the mold and/or casting into the adjacent concrete curb.

The mold 800' also has at least one or more sideways elongated and L-shaped handles 815 that are spaced apart and connects the top of the nose guard 829 to the back wall 801 of the mold. The elongated and L-shaped handles have a horizontal section extending from below the upper edge of the nose guard 829 backward to a point substantially above the rear edge of top 824 that connects to back wall 805, being then connected to vertical portion descending downward to proximate the junction between the rear edge of top 824 and the back wall 805.

Thus, in installing the mold 800' an external frame, or simply the vertical trench surface (shown as dotted line 813 in FIG. 8C) provides a convenient means to form the cavity or trough 820' that retains the fluid concrete that is poured to the complete the fabrication of top section 120.

While the invention has been described in connection with preferred embodiments, it is not intended to limit the scope of the invention to the particular form set forth, but on the contrary, it is intended to cover such alternatives, modifications, and equivalents as may be within the spirit and scope of the invention as defined by the appended claims.

For example, in any of the previously described embodies the reinforcing nose can be formed of thicker metal than the rest of the molds or forms, an extra sheet, strip or L-shaped bar of metal, by folding over the metal edge to double the thickness, and the like.

The invention claimed is:

1. A mold for forming a gallery section for draining into a catch basin, a) a substantially horizontal rectangular channel having two parallel elongated vertical sides connected to two opposite shorter vertical sides, wherein at least one elongated vertical sides is open on the upper portion thereof to form a fluid directing channel, the open side disposed vertically for receiving fluid flowing in the horizontal direction, the channel further comprising a bottom horizontal portion connected to the vertical sides, b) a cover for retaining fluid concrete disposed above the horizontal surface that defines the top of said substantially horizontal rectangular channel, c) a metal nose guard extending upward along the edge of said cover for retaining fluid concrete adjacent the open side of said substantially horizontal rectangular channel, d) one or more elongated handles having a horizontal section extending backward from below the upper edge of said metal nose guard backward to a point substantially above the extension beyond the opposite side of said substantially vertical rectangular channel being then connected to the vertical portion for descending downward to connect to the opposite side of said a substantially vertical rectangular channel.

2. A mold for forming a gallery section for draining into a catch basin according to claim 1 wherein said channel has an upper portion and an lower portion wherein the lower portion is narrower than the upper portion and the upper portion includes a convex surface that curves downward from the bottom of the opening in the upper portion of the elongated vertical side to the top of the lower portion.

3. A mold for forming a gallery section for draining into a catch basin, according to claim 1 and further comprising a trash guard rail extending laterally across the open side of said rectangular channel.

4. A mold for forming a gallery section for draining into a catch basin, according to claim 3 further comprising at least one support plate disposed vertically across the open side of said rectangular channel and supporting the central portion of the trash guard rail disposed substantially between said two opposite shorter vertical sides.

5. A mold for forming a gallery section for draining into a catch basin, according to claim 3 wherein the mold is formed of steel or galvanized iron.

6. A mold for forming a gallery section for draining into a catch basin, according to claim 1 that is filled with concrete whereby the handles are embedded therein to provide substantial reinforcement thereof.

7. A mold for forming a gallery section for draining into a catch basin, according to claim 1 wherein the angle between the open elongated vertical side and the bottom portion of the rectangular channel is less than 90 degrees.

8. A mold for forming a gallery section for draining into a catch basin, according to claim 7 wherein the angle between the open elongated vertical side and the bottom portion of the rectangular channel is greater than 80 degrees.

9. A mold for forming a gallery section for draining into a catch basin, according to claim 7 wherein one of the two shorter vertical sides is disposed orthogonal to the two parallel elongated vertical sides and the opposite shorter vertical sides is disposed at an angle of less than 90 degrees with respect to the open elongated vertical side.

10. A mold for forming a gallery section for draining into a catch basin, according to claim 1 wherein the elongated vertical sides opposite the open elongated vertical side is dispose orthogonal to said cover.

11. A mold for forming a draining cover for a catch basin, the mold comprising:

(a) a frame that extends in the horizontal direction, having substantially vertical planar face portion and a substantially horizontal planar upper portion joined at a common edge to form an inverted L shape, each planar portion having an opposing edge opposite the common edge there between, (b) a metal nose guard extending upward from the opposing edge of substantially horizontal planar upper portion to an upper edge thereof, (c) a horizontal bottom edge extending laterally outward from the opposing edge of the substantially vertical planar face portion in the opposite direction as the substantially horizontal planar upper portion, (d) one or more elongated handles having a horizontal section extending backward from below the upper edge of said metal nose guard backward to a point substantially above the common edge of the substantially vertical planar face portion and a substantially horizontal planar upper portion followed by a vertical portion extending downward to connect proximate the common edge.

12. A mold for forming a draining cover for a catch basin according to claim 11 wherein the metal noise guard is thicker than the metal that forms the horizontal upper portion.

13. A mold for forming a draining cover for a catch basin according to claim 12 wherein at least a portion of the metal noise guard is folded to define a rounded rim at the upper edge thereof.

14. A mold for forming a draining cover for catch basin according to claim 13 wherein said one or more elongated handles is a metal rod that is connected to the metal noise guard at the termination of the fold below the rim.

15. A mold for forming a draining cover for catch basin according to claim 11 wherein the angle between the substantially vertical planar face portion and the substantially horizontal planar upper portion is greater than about 90 degrees.

16. A mold for forming a draining cover for catch basin according to claim 11 further comprising at least one side having at least a portion disposed substantially perpendicular to the vertical and horizontal portions of said frame, the side descending downward from the horizontal portion of the frame to the horizontal bottom edge thereof.

17. A mold for forming a draining cover for catch basin according to claim 16 further comprising a second side disposed oppose said first side on said frame said second side descending downward from the horizontal portion of the frame to the horizontal bottom edge thereof.

18. A mold for forming a draining cover for catch basin according to claim 17 and further comprising a trash guard rail extending between said first and second side.

19. A mold for forming a draining cover for catch basin according to claim 11 that is filled with concrete whereby the handles are embedded therein to provide substantial reinforcement thereof.

20. A mold for forming a draining cover for catch basin according to claim 17 wherein said first side is convex so that the elongated horizontal side is short at the common edge than the opposing edge thereof.

* * * * *